US005513824A

United States Patent [19]

Leavitt et al.

[11] Patent Number: 5,513,824

[45] Date of Patent: May 7, 1996

[54] NEUTRAL POSITIONS KEYBOARD/WRIST SUPPORT

[75] Inventors: Stewart B. Leavitt, Glenview, Ill.; Gary E. Lawson, Cheektowaga, N.Y.

[73] Assignee: Mead-Hatcher, Inc., Buffalo, N.Y.

[21] Appl. No.: 205,952

[22] Filed: Mar. 3, 1994

[51] Int. Cl.[6] ..... B43L 15/00

[52] U.S. Cl. ..... 248/118.3; 248/918; 400/715

[58] Field of Search ..... 248/118, 118.1, 248/118.3, 118.5, 456, 455, 918; 400/715

[56] References Cited

U.S. PATENT DOCUMENTS

| | | | |
|---|---|---|---|
| Re. 33,556 | 3/1991 | Berke | 248/69 |
| 1,799,781 | 4/1931 | Chalfant | 248/118 X |
| 2,509,086 | 5/1950 | Eaton | 248/118 X |
| 2,792,668 | 5/1959 | Gallomos | 248/456 |
| 4,226,464 | 10/1980 | Jony et al. | 248/118 X |
| 4,441,432 | 4/1984 | Carlton | 248/456 X |
| 4,545,554 | 10/1985 | Latino et al. | 248/118.1 |
| 4,913,390 | 4/1990 | Berke | 248/176 |
| 5,040,757 | 8/1991 | Benaway | 248/118 |
| 5,048,784 | 9/1991 | Schwartz et al. | 400/715 X |
| 5,050,826 | 9/1991 | Johnston | 248/118 |
| 5,088,668 | 2/1992 | Grimm | 248/118 |
| 5,104,073 | 4/1992 | VanBeek et al. | 248/113 |
| 5,145,270 | 9/1992 | Darden | 400/448 |
| 5,158,256 | 10/1992 | Gross | 248/118 |
| 5,211,367 | 5/1993 | Musculus | 248/918 X |
| 5,219,136 | 6/1993 | Hassel et al. | 248/118 |
| 5,242,139 | 9/1993 | Aldrich | 248/118 |
| 5,375,800 | 12/1994 | Wilcox et al. | 248/118.1 |

FOREIGN PATENT DOCUMENTS

| | | | |
|---|---|---|---|
| 9420410 | 9/1994 | WIPO | 248/118 |

*Primary Examiner*—Alvin C. Chin-Shue
*Assistant Examiner*—Korie H. Chan
*Attorney, Agent, or Firm*—Hodgson, Russ, Andrews, Woods & Goodyear

[57] ABSTRACT

A neutral-positioning keyboard/wrist support device (10) is described. The support device comprises a wrist support member (12) having a cushion means (46) mounted thereon with the support member being adjustably movable with respect to first vertical slots (28,30) provided in a base member (14) to provide various vertical height elevations for the cushion means above a support surface (20). A keyboard (16) is supported on a platform (18) having a proximal end (84) that is engagable with pairs of tabs (92,94 and 96) extending from a bracket portion (98) of the wrist support to provide for adjusting the slope of the platform and thereby the associated keyboard. The vertical height of the cushion means is spaced above the keyboard. This enables the typist to have her hands in a "neutral" posture resting on the cushion means with the wrists positioned such that the hands are approximately in a horizontal plane to reach the keyboard keys.

22 Claims, 5 Drawing Sheets

144
146
142B
148
142
143
142A
149A
149B
149C
149D
149E
150
136
112
168
158
176
174
174A
174B
174C
174D
174E
172
170
166
138
180
178
124B
132
124A
128
124C
124
114
140
152
154
122
130
134
126
126A
7

NEUTRAL POSITIONS KEYBOARD/WRIST SUPPORT

BACKGROUND OF THE INVENTION

The present invention relates to office machines having a keyboard. In particular, the present invention relates to a support device comprising an adjustable wrist support part and an independently adjustable keyboard support part. The keyboard support in conjunction with the wrist support provides for positioning a typist's hands at a keyboard in a "neutral" attitude or posture with the wrists approximately in a horizontal position. This helps relieve wrist and hand strain associated with repetitive typing motions.

In that respect, the wrist support part of the present invention is positioned adjacent to the typist and is vertically adjustable through a variety of heights above a front edge of the keyboard. This provides for supporting the typist's hands proximate the keyboard at a variety of vertical heights with the wrists about in a horizontal position reaching towards the keyboard. Additionally, the tilt angle of the wrist support can be adjustable independent of the vertical height of the wrist support.

The keyboard support part of the present invention has a vertically adjustable proximal end adjacent to the wrist support that provides for maintaining the associated keyboard in a variety of sloping positions ranging from a positive incline with the tiers of keys sloping towards the typist to a reversely sloping decline having the keys sloping downwardly and away from the typist. The keyboard can be of any type including a typewriter, a computer keyboard, and a stenographic machine keyboard. Thus, the independently adjustable vertical height and tilt angle of the wrist support and the adjustable height and sloping positions for the keyboard support provide the neutral hand posture that helps prevent hand-debilitating afflictions such as Carpal Tunnel Syndrome.

PRIOR ART

The prior art has described numerous devices that provide for adjustably supporting the hands and wrists of a typist. The vast majority of these devices provide a hand rest that is vertically adjustable to raise and lower the hands and wrists with respect to a keyboard. Typically, the keyboard is positioned with the keys in a "stair-step" configuration, having approximately four rows of keys sloping towards the typist. The problem is that while the hands and wrists can be raised to various heights above the keyboard, the slope of the keys still requires the typist to have her hands in a "cocked" posture bent upwardly at the wrists.

Some devices are provided that position the hands on a rest member in front of a keyboard having a reversely sloping decline with the rows of keys sloping downwardly, away from the typist. One such device is described in U.S. Pat. No. 5,145,270 to Darden, titled "Reverse Sloped Keyboard". This reversely sloping keyboard comprises an integral raised wrist support provided in front of a keyboard having its tiers of keys arranged in descending stepwise fashion towards the lower rear edge of the keyboard. The keyboard is hinged to a platform that provides for adjusting the magnitude of the reverse slope of the keyboard and the vertical height of the wrist support. However, these adjustments are not independent of each other.

U.S. Pat. No. 5,040,757 to Benaway describes a unitary wrist support device having a stepped upper surface and a vertically elevated wrist support. The stepped upper surface supports the front edge of a keyboard at various angles of inclination, however, the vertical height of the wrist support is not adjustable.

There is therefore a need for a keyboard support device that is useful for supporting the hands and wrists of a typist in a "neutral position" wherein the tiers of keyboard keys are sloped vertically below a wrist support upon which the typist rests the heal of her hands. This provides the typist with a "neutral" hand posture requiring the wrists to be positioned such that the hands are about in a horizontal plane to reach the keyboard keys. To provide optimum comfort, the vertical height and tilt angle of the wrist support needs to be adjustable independently of the adjustment for the height and sloping position of the keyboard.

OBJECTS

It is therefore an object of the present invention to provide a neutral-positioning keyboard/wrist support device comprising a keyboard support part that provides various height and sloping positions for a keyboard, vertically below a wrist support part that is adjustable to various vertical heights above the keyboard, the adjustment for the keyboard support being independent of the adjustment for the wrist support.

Further, it is an object of the present invention to provide a neutral-positioning keyboard/wrist support device comprising a wrist support part that is vertically adjustable to various heights and through a range of tilt angles, adjacent to and above a keyboard support part that provides various heights and sloping positions for a keyboard, wherein the adjustments for the wrist support are independent of those for the keyboard support.

Finally, it is an object of the present invention to provide a neutral-positioning keyboard/wrist support device that is inexpensive to manufacture, easy to use and that provides a typist working at a keyboard with a "neutral" hand posture having her wrists positioned such that the hands are about in a horizontal plane to reach the keyboard keys.

These and other objects will become increasingly apparent to those of ordinary skill in the art by reference to the following detailed description and the drawings.

IN THE DRAWINGS

Figures 5, 6, 7, 8:
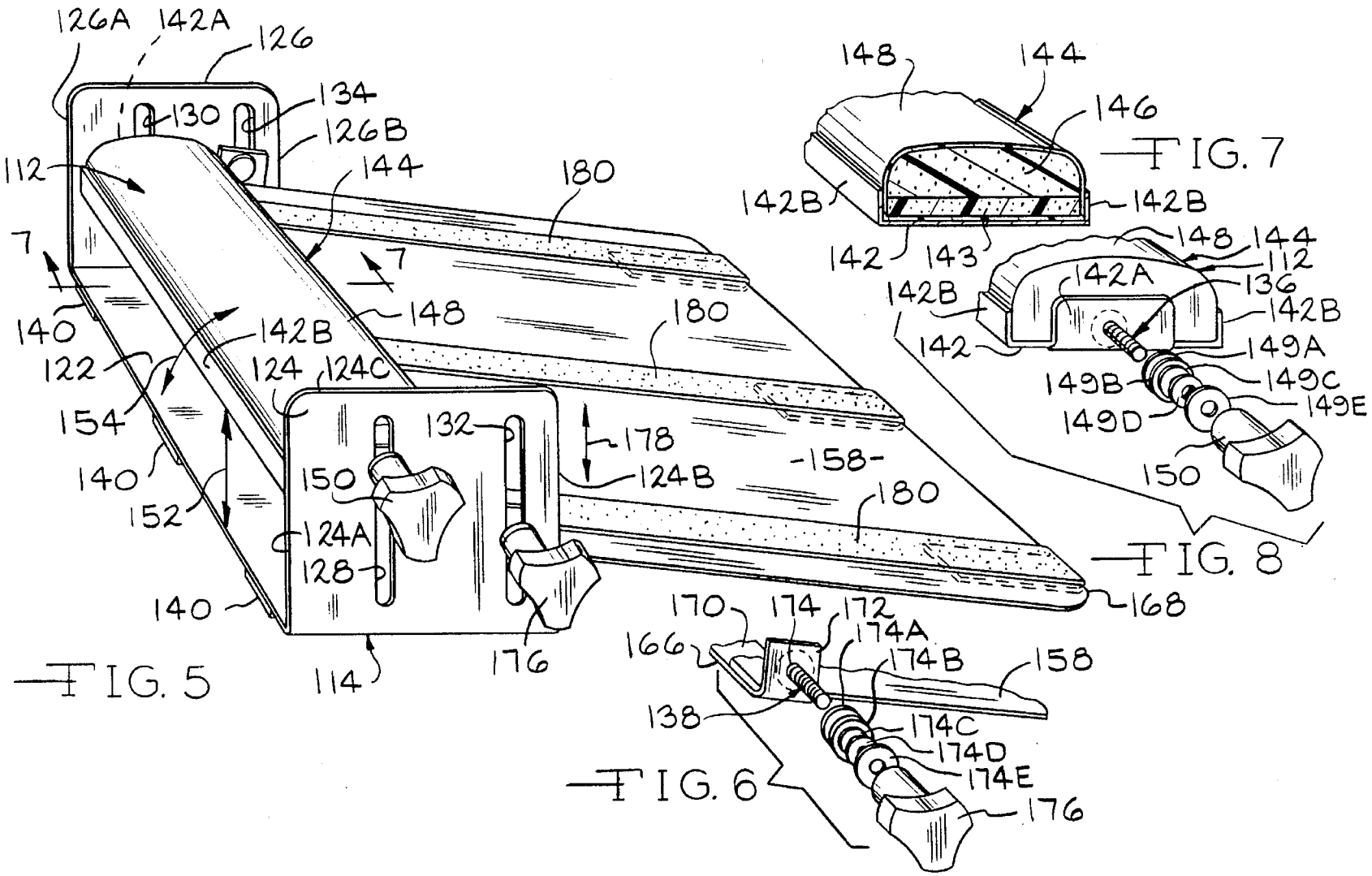
FIG. 5 is a perspective view of a neutral-positioning keyboard/wrist support device 110 of the present invention.
FIG. 6 is a broken away, separated view of a keyboard platform 118 of the keyboard/wrist support device 110 shown in FIG. 5.

FIG. 7 is a cross-sectional view along line 7—7 of FIG. 5 showing a wrist support 112 of the keyboard/wrist support device 110.

FIG. 8 is a broken away, separated view of the wrist support 112 of the keyboard/wrist support device 110 shown in FIG. 5.

Figure 9:
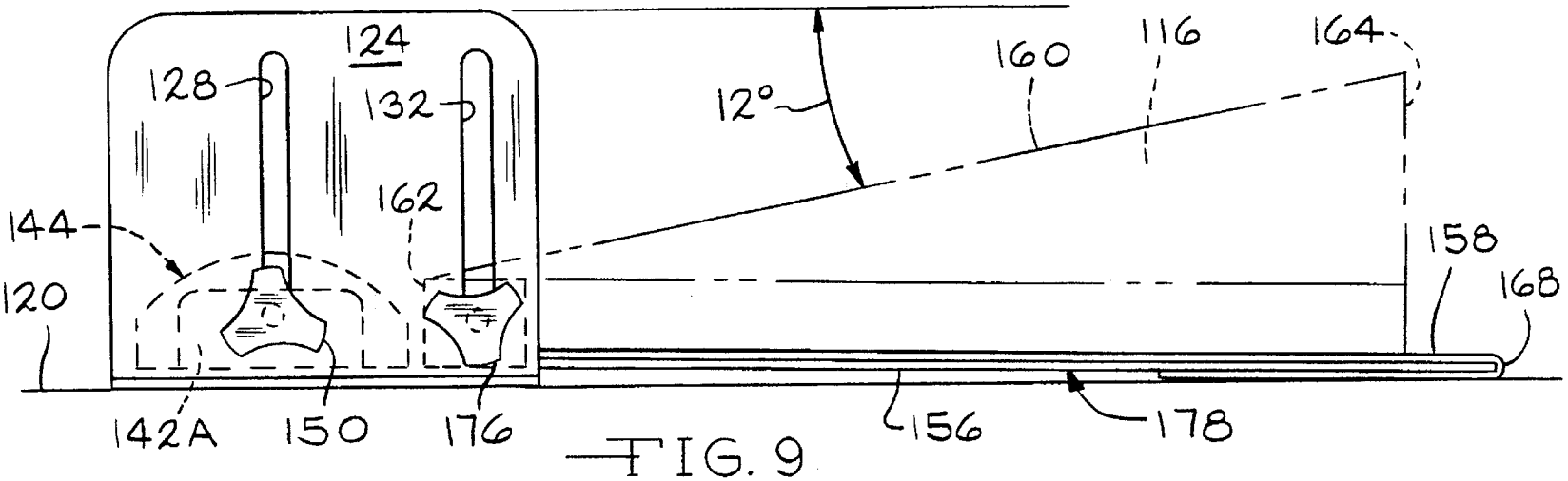

FIG. 9 is a side elevation view of the keyboard/wrist support device 110 shown in FIG. 5 with the keyboard platform 118 positioning an associated keyboard 116 in a sloping incline toward the wrist support 112 and with the wrist support 112 at a lower most vertical position.

Figure 10:
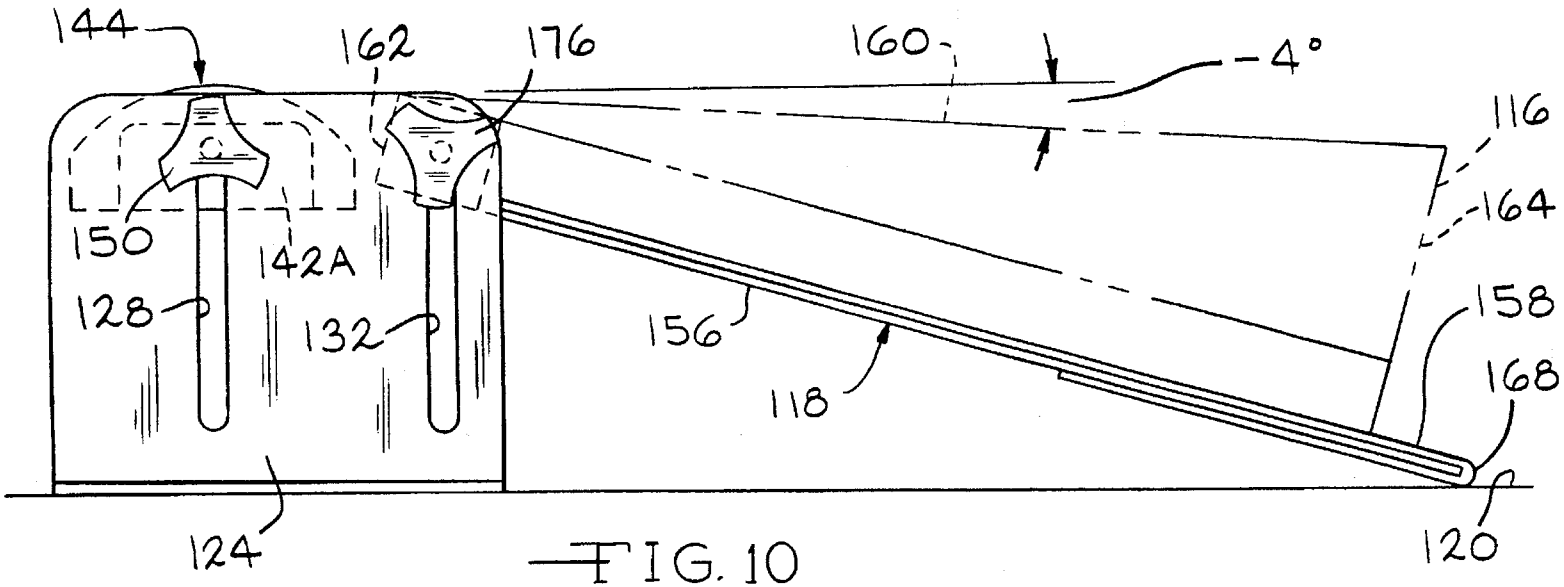

FIG. 10 is a side elevational view of the keyboard/wrist support device 110 shown in FIG. 5 with the wrist support 112 at its upper most vertical height and with the platform 118 and keyboard 116 at a reversely sloping decline position.

Figures 11, 12:
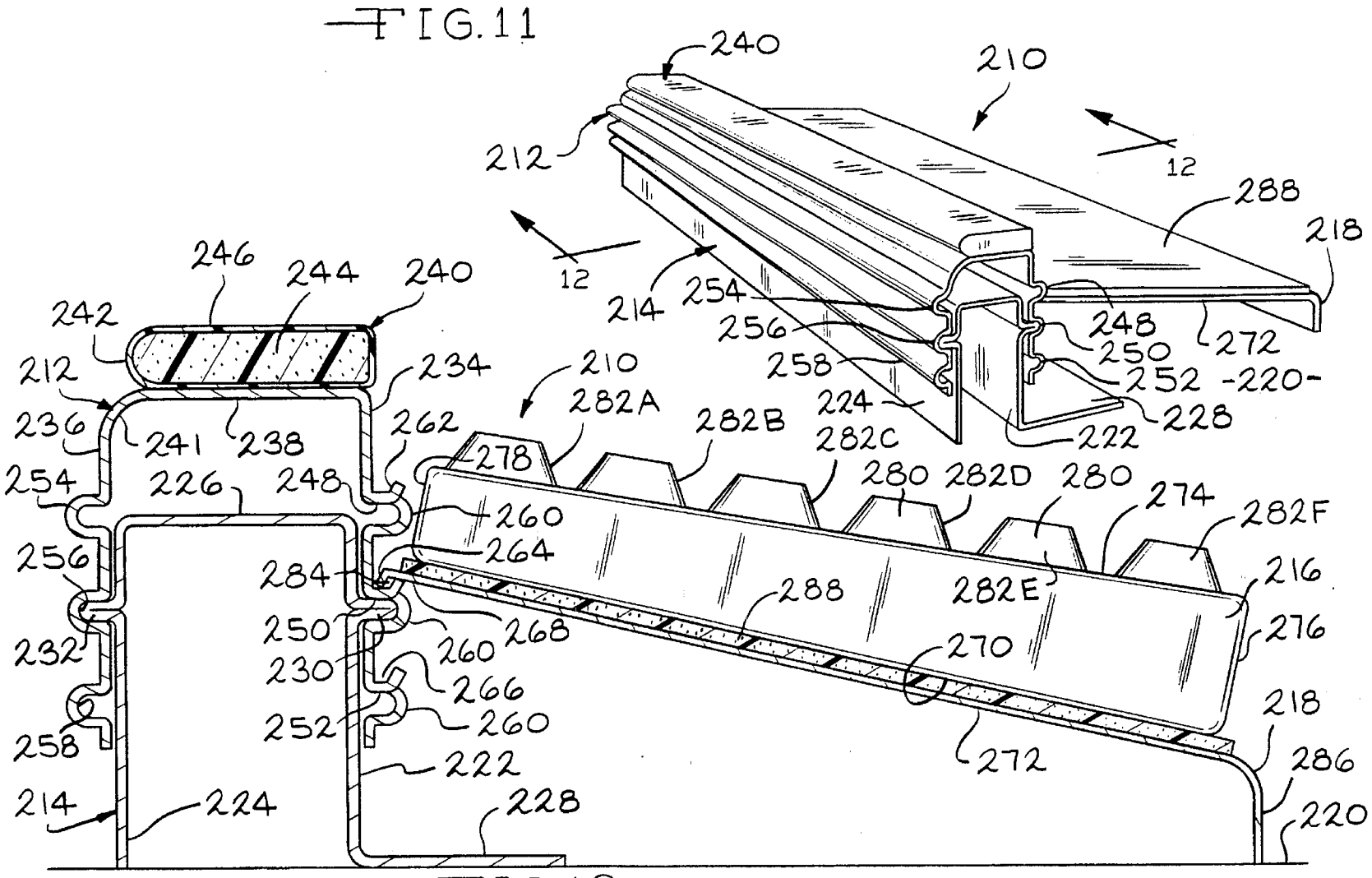

FIG. 11 is a perspective view of another embodiment of a neutral positioning keyboard/wrist support device 210 of the present invention.

FIG. 12 is a cross-sectional view, on an enlarged scale, taken along lines 12—12 of FIG. 11 thereof and showing a keyboard 216 supported in a reversely sloping decline.

DETAILED DESCRIPTION

The terms "upper", "lower", "front", and "back" simply refer to the orientation of FIGS. 1 to 12, and are not intended to be limiting.

Referring now to the drawings, FIGS. 1 to 4 show one embodiment of a neutral-positioning keyboard/wrist support device 10 of the present invention. Support device 10 comprises a wrist support means 12 adjustably supported on a base means 14 and having an associated keyboard 16 (shown in dashed lines in FIG. 1) positioned on a platform 18 that is adjustably attached to base 14. This construction provides various vertical height adjustments for wrist support 12 above a support surface 20 (FIG. 3) for base 14 independent of various adjustments for the vertical height and slope of platform 18 and keyboard 16, as will be explained in detail presently. Support surface 20 may be a tabletop, the top of a desk or other like surface upon which a computer monitor (not shown) operatively associated with keyboard 16 is positioned.

Figure 4:
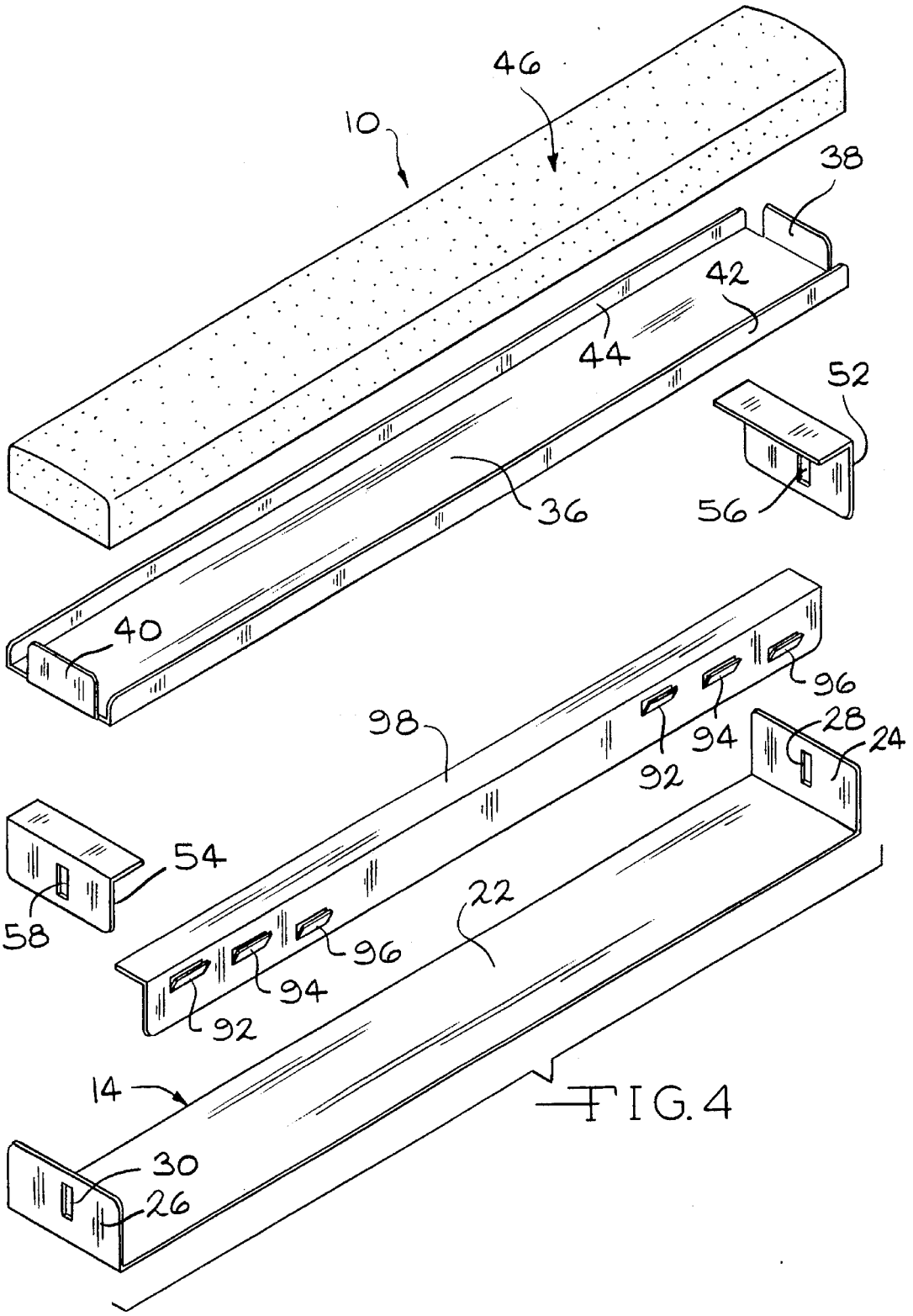
FIG. 4 is an exploded view of a wrist support 12 including a base 14 of the keyboard/wrist support device shown in FIG. 1.

As particularly shown in FIG. 4, base means 14 is preferably fabricated as an integral member made from a sheet of suitable metal material that has been cut to size and folded to the proper shape, or base 14 can be made of a plastic material that has been injection molded to shape or any other suitable material. Base 14 is a longitudinally extending member comprised of a base plate 22 having a rectangular shape with spaced apart side walls 24 and 26 extending upwardly in vertically extending planes from the opposed short sides of base plate 22. Sidewalls 24 and 26 are parallel with respect to each other. Friction means (not shown) can be attached to the underside of base plate 22 to prevent base 14 from sliding on support surface 20.

Sidewalls 24 and 26 are also respectively provided with vertically extending adjusting slots 28 and 30. Slots 28 and 30 are aligned with each other and have similar rectangular shapes sized to allow adjusting movement therealong of a rod means 32 and 34 (shown in dashed lines in FIG. 3) comprising the wrist support 12. This provides an adjustment means for the wrist support 12, as will be explained in detail presently.

As particularly shown in FIG. 4, support means 12 comprises a rectangular shaped support plate 36 with spaced apart vertical side walls 38 and 40 extending upwardly from the opposed short sides of support plate 36 and spaced apart lateral side walls 42 and 44 extending upwardly from the opposed long sides of plate 36. Support plate 36 is made of a suitable material, such as metal or an injection molded plastic material, preferably metal, and supports a generally rectangular shaped cushion means 46 mounted thereon and positioned between side walls 38, 40 and 42,44. Cushion 46 extends the entire length of support plate 36 and is preferably made of foam rubber 48 (FIG. 3) or other suitably spongy material having a durable cover 50 with a generally curved upper surface.

A pair of inverted L-shaped brackets 52 and 54 are mounted on the underside of plate 36 adjacent to side walls 38 and 40 such that the long sides of brackets 52 and 54 depend downwardly and in a similar vertical plane as respective side wall 38 and 40. The long sides of brackets 52 and 54 are aligned with each other and they are provided with vertically extending adjusting slots 56 and 58, respectively. Slots 56 and 58 each have a rectangularly shaped size similar to slots 28 and 30 provided on base 14 to allow adjusting movement therealong of rod means 32 and 34 (shown in dashed lines in FIG. 3) when support means 12 is fitted between side walls 24 and 26 of base 14.

Plate 36 has a length that is sufficient to snugly fit between the upwardly extending side walls 24 and 26 of base member 14 with rod means 32 and 34 comprising oppositely extending carriage bolts (FIG. 2) having their heads positioned on the inside of the long side of brackets 52 and 54 and their threaded shafts extending outwardly through slots 56 and 58 and through slots 28 and 30 in base 14. A flat washer 60 and a synthetic washer 62, preferably made of TEFLON, are mounted on the threaded shaft of each bolt 32 and 34 between the vertical sides of brackets 52 and 54, and side walls 24 and 26 of base 14. Lock washers (not shown) can also be provided on the shafts of each bolt 32. Threadably adjustable hand wheel means or knobs 64 and 66 are threadingly received on each carriage bolt 32 and 34. Hand knobs 64 and 66 and bolts 32 and 34 cooperate with adjusting slots 28 and 30 in base 14 and slots 56 and 58 in brackets 52 and 54 of support 12 as an adjusting means for varying and then locking the vertical elevation of support 12 above base plate 22 of base 14, as indicated by arrow 68 in FIG. 1. The adjustment for the vertical elevation of support member 12 will be explained in detail presently.

Figure 1:
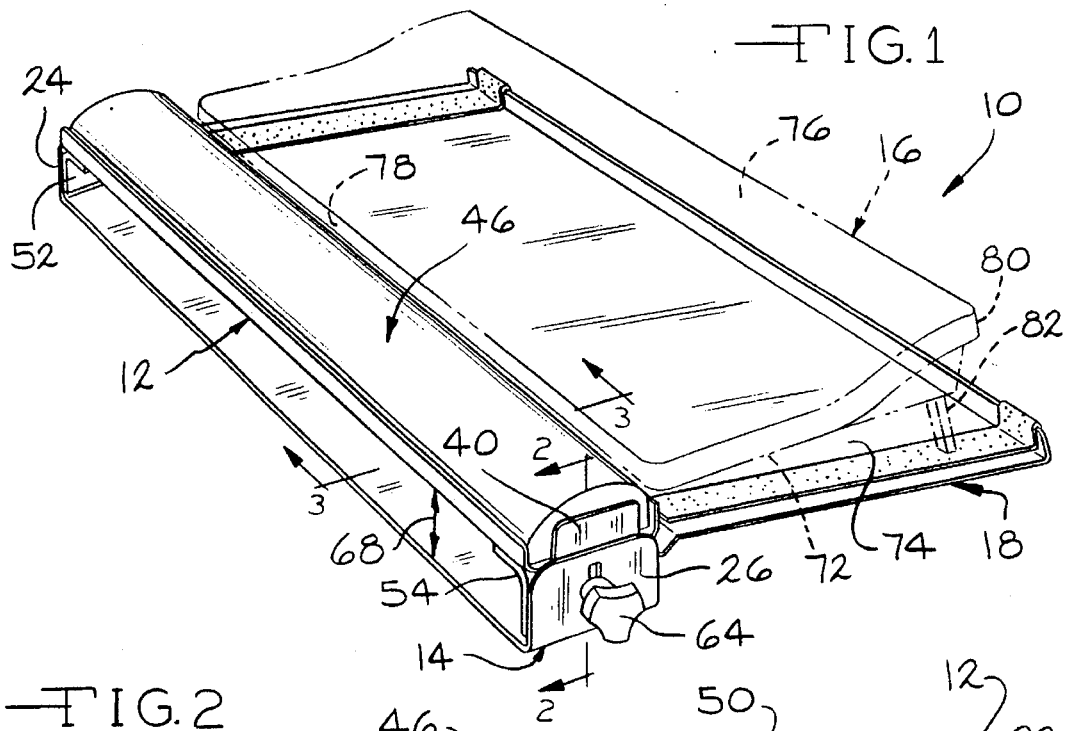
FIG. 1 is a perspective view of a neutral-positioning keyboard/wrist support device 10 of the present invention.
Figure 2:
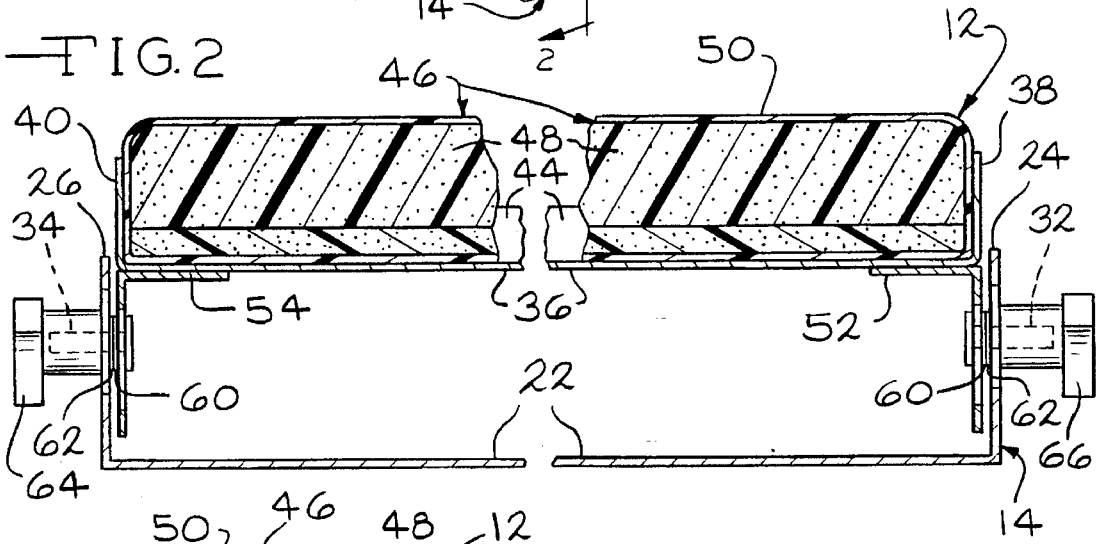
FIG. 2 is a cross-sectional view along line 2—2 of FIG. 1.

As shown in FIG. 1, platform 18 is preferably approximately as wide as keyboard 16 (shown in dashed lines in FIG. 1). Keyboard 16 is a conventional type of the kind that is customarily associated with a computer terminal or computer workstation (not shown) and the like. Keyboard 16 comprises a planar lower side 72 positioned on a generally flat plate portion 74 of platform 18, and an upper side 76 extending to and connecting between back and front sides 78 and 80. The width between the lower side 72 and the upper side 76 widens as the keyboard 16 extends from its front side 78 to the back side 80. A plurality of keys (not shown) are arranged in rows extending above the upper side 76 of keyboard 16 to provide tiers of keys extending from the front side 78 towards the back side 80 of keyboard 16, as is well known to those of ordinary skill in the art. A pair of flip-out legs 82 (only one leg 82 is shown in dashed lines in FIG. 1) are provided adjacent to the corners of keyboard 16 at the back side 80 to provide for adjusting the tilt angle of the lower side 72 with respect to the plate portion 74 of platform 18.

Figure 3:
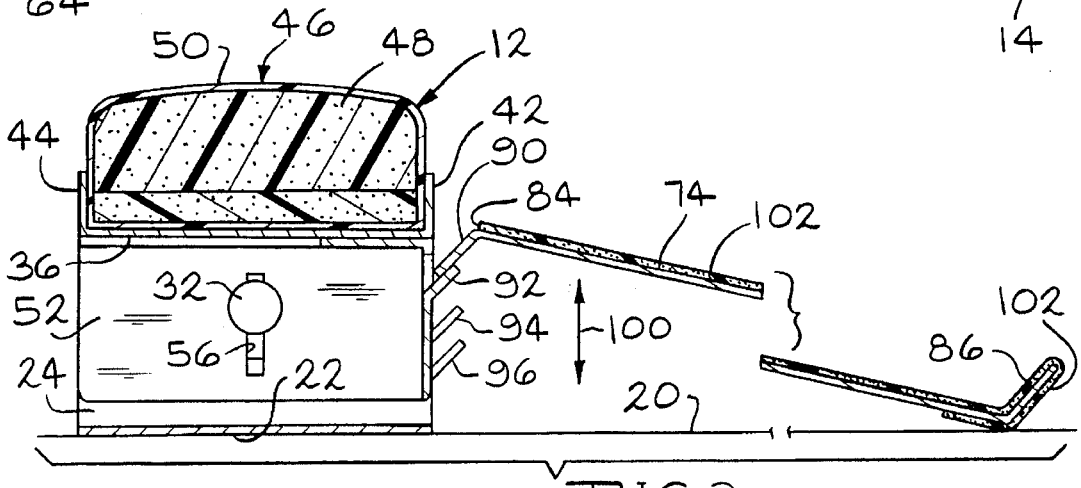
FIG. 3 is a cross-sectional view along line 3—3 of FIG. 1.

As shown in FIGS. 1 and 3, plate 74 extends between a proximal end 84 and a distal end 86 having an upwardly extending flange portion 88 that prevents keyboard 16 from moving off of platform 18 in the direction of flange 88 with the proximal end 84 contacting the support means 12 and the distal end 86 positioned on support surface 20. The proximal end 84 of platform 18 has an upwardly extending flange portion 90 that cooperates with respective pairs of spaced apart and outwardly extending tabes 92,94 and 96 cut out of the long leg of an inverted L-shaped bracket 98 attached to the underside of plate 36 of support means 12 adjacent to and beneath lateral side 42. The spaced apart tabs comprising each pair 92,94 and 96 are provided in descending elevational altitude adjacent to the opposed ends of the bracket 98 and cooperate with flange 90 received therein. This provides an adjusting means for varying the vertical length of the proximal end 84 of platform 18, as indicated by arrow 100 in FIG. 3. The adjustment for the vertical height of proximal end 84 will be described in detail presently.

Friction strip 102 are positioned at spaced locations along the width of platform 18, running from the proximal end 84 to the distal end 86 with a portion mounted on the under side of platform 18. Strips 102 are preferably made of an elastomeric material or they can be made of a cork material or the like. What is important is that strips 102 serve to grip the bottom side on platform 18.

In used a typist will be seated in a chain (not shown) in front of table 20 and adjacent to support 12. The vertical height of cushion 46 above base plate 22 of base member 14 is varied by manipulation of hand knobs 64 and 66 to the left or in a counterclockwise direction as viewed in FIG. 1 for knob 64. This causes the knobs 64 and 66 to unthread from their threaded relationship with bolts 32 and 34, which in turn causes that section of sidewalls 24 and 26 in the vicinity of slots 28 and 30 to release from their friction engagement with the opposed brackets 52 and 54 of support means 12. The vertical height of the wrist support 12 is then adjusted, as shown by arrow 68 in FIG. 1, by moving wrist support 12 vertically up and down with bolts 32 and 34 moving along the length of adjusting slots 28 and 30 in base 14 and along slots 56 and 58 in support 12.

After wrist support 12 is adjusted to a comfortable vertical height, the position of wrist support 12 is locked in place by threading knobs 64 and 66 in a right or clockwise direction as viewed in FIG. 1 for knob 64 to increase the threaded engagement between knobs 64 and 66 and bolts 32 and 34. This causes the knobs 64 and 66 to contact the upwardly extending sidewalls 24 and 26 of base 14 to draw them into a friction fit with the opposed vertical portions of brackets 52 and 54 of wrist support 12. The friction fit between knobs 64 and 66, sidewalls 24 and 26 and brackets 52 and 54 serves to lock both the tilt angle and vertical height of the wrist support 12 at the desired position.

The angle of inclination of platform 18 is adjustable through a range of slopes by engaging the proximal flange 90 of platform 18 with the respective pairs of tabs 92,94 and 96. Flange 90 is shown engaged with tabs 92 in FIG. 3. In this manner, the slope of the platform 18 ranges from about 6° to about 8° to about 9° corresponding to the respective tabs 92, 94 and 96 with wrist support 12 in a lowermost extent (not shown) in slots 56 and 58. With wrist support 12 in an uppermost extent (not shown) in slots 56 and 58, the slope of platform 18 ranges from about 11° to about 13° to about 14° corresponding to the respective tabs 92, 94 and 96. That way, when the typist rests her hands on the cushion 46 of wrist support 12, she will need to reach approximately in a horizontal direction to strike the keys when working on a wide variety of keyboards. This provides the typist with a "neutral" hand posture that helps alleviate hand stress caused by the typing motion.

Independent of the adjustment for the keyboard 16 and slope of platform 18, wrist support 12 is vertically adjustable through a variety of heights with threaded bolts 32 and 34 of wrist support 12 movable along the length of adjusting slots 28 and 30 in base 14 and along adjusting slots 56 and 58 in brackets 52 and 54 of wrist support 12, as has previously been described in detail. Thus, with the wrist support 12 at any preferred position vertically above the proximal end 84 of platform 18, the typist is required, with her hands resting on cushion 46, to reach approximately in a horizontal direction to strike the keyboard keys. This provides a "neutral" hand posture that helps relieve hand stress caused by the typing motion.

FIGS. 5 to 10 show another embodiment of a neutral-positioning keyboard/wrist support device 110 of the present invention. Support device 110 comprises a wrist support means 112 adjustably supported on a base means 114 and having an associated keyboard 116 (shown in dashed lines in FIGS. 9 and 10) positioned on a platform 118 that is adjustably attached to base 114. This construction provides various vertical height adjustments for wrist support 112 above a support surface 120 (FIGS. 9 and 10) for base 114 independent of various adjustments for the vertical height and slope of platform 118 and keyboard 116, as will be explained in detail presently. Support surface 120 may be a tabletop, the top of a desk or other like surface upon which a computer monitor (not shown) operatively associated with keyboard 116 is positioned.

Base means 114 is preferably fabricated as an integral member made from a sheet of suitable metal material that has been cut to size and folded to the proper shape, or base 114 can be made of a plastic material that has been injection molded to shape. Base 114 can also be made of wood or any other suitable material and is a longitudinally extending member comprised of a base plate 122 having a rectangular shape with spaced apart side walls 124 and 126 extending upwardly in vertically extending planes from the opposed short sides of base plate 122. Sidewalls 124 and 126 are parallel with respect to each other and comprise respective front and back edges 124A, 126A and 124B, 126B extending upwardly to curved portions joining top sides 124C and 126C. Sidewalls 124 and 126 are also respectively provided with vertically extending adjusting slots 128 and 130 and adjusting slots 132 and 134. Slots 128 to 134 have a rectangular shape with rounded ends such that slots 128 and 130 are sized to allow adjusting movement of a rod means 136 (FIG. 8) comprising the wrist support 112 therealong and slots 132 and 134 allow adjusting movement of a rod means 138 (FIG. 6) comprising the platform 118 to provide adjustment means for the wrist support 112 and platform 118, as will be explained in detail presently.

As particularly shown in FIGS. 5 and 8 to 10, first slots 128 and 130 and second slots 132 and 134 have similar lengths, wherein first slots 128 and 130 are positioned towards the front edges 124A and 126A along the width of side walls 124 and 126 (FIG. 5) while second slots 132 and 134 are positioned adjacent to the back edges 124B and 126B of side walls 124 and 126. In use, the typist will be seated in a chair (not shown) in front of table 120 and adjacent to first slots 128 and 130. A plurality of friction straps 140, preferably of an elastomer material, are attached at spaced locations along the under side of bottom plate 122 to prevent base 114 from sliding on support surface 120.

As particularly shown in FIGS. 7 and 8, support means 112 comprises a rectangular shaped support plate 142 with spaced apart vertical side walls 142A (only one side wall 142A is shown in FIG. 7) extending upwardly from the opposed short sides of support plate 142 and spaced apart lateral side walls 142B (only one lateral side wall 142B shown in FIG. 5) extending upwardly from the opposed long sides of plate 142. Support plate 142 is made of a suitable materials such as metal or an injection molded plastic material, preferably metals and supports a rectangular shaped block 143 fitted between lateral side walls 142B to hold a cushion means 144 mounted thereon. Cushion 144 extends the entire length of support plate 142 and is preferably made of foam rubber 146 or other suitably spongy material having a durable cover 148 with a generally curved upper surface.

Support means 112 is further provided with the rod means 136 comprising oppositely extending carriage bolts (only one bolt 136 is shown in FIG. 8) having their heads positioned on the inside of side walls 142A (shown in dashed lines in FIG. 8), and, their threaded shafts extending outwardly through the vertical side walls 142A of support plate 142 and through slots 128 and 130 and beyond side walls 124 and 126 (not shown in FIG. 5). Plate 142 has a length that is sufficient to snugly fit between the upwardly extending side walls 124 and 126 of base member 114 with rod means 136 extending through slots 128 and 130. A lock washer 149A, flat washer 149B and a synthetic washer 149C, preferably made of TEFLON, are mounted on the threaded shaft of each bolt 136 between vertical side wall 142A of support 112, and side walls 124 and 126 of base 114. Threadably adjustable hand wheel means or knobs 150 are threadingly received on each carriage bolt 136 (only one hand knob 150 is shown in FIGS. 5 and 8 to 10) with a synthetic washer 149D, preferably made of TEFLON, and a flat washer 149E, mounted on the threaded shaft of each bolt 136 between side walls 124 and 126 of base 114 and the hand knobs 150. Hand knobs 150 and bolts 136 cooperate with adjusting slots 128 and 130 as an adjusting means for varying and then locking the vertical elevation of support 112 above base plate 122 of base 114, as indicated by arrow 152 in FIG. 5, and for varying the tilt angle of support 112 about the axis of the rod means 136, as indicated by arrow 154. The adjustments for the vertical elevation and tilt angle of support member 112 will be explained in detail presently.

As shown in FIGS. 5 and 6, platform 118 is preferably approximately as wide as keyboard 116 (shown in dashed lines in FIGS. 9 and 10), which is a conventional type of the kind that is customarily associated with a computer terminal or computer workstation (not shown) and the like. Keyboard 116 comprises a planar lower side 156 positioned on a generally flat plate portion 158 of platform 118 (FIG. 5) and an upper side 160 with connecting back and front ends 162 and 164. In side elevational view (FIGS. 8 to 10), the width between the lower side 156 and the upper side 160 widens as the keyboard 116 extends from its front side 162 to the back side 164. A plurality of keys (not shown) are arranged in rows extending above the upper side 156 of keyboard 116 to provide tiers of keys extending from the front side 162 towards the back side 164 of keyboard 116, as is well known to those of ordinary skill in the art.

As shown in FIG. 5, platform 118 is a longitudinally extending member comprised of the generally flat plate portion 158 that serves to support keyboard 116 (not shown in FIG. 5), and plate 158 extends between a proximal end 166 (FIG. 6) and a distal end 168, positioned on support surface 120. The proximal end 166 of platform 118 support a strip having opposed upwardly extending tabs 172 that support bolts 138 (only one tab 172 and bolt 138 is shown in FIG. 6). Strip 170 and platform 118 are preferably made of a metal material, in which case they are welded to form an integral unit. Other suitable materials of construction can also be used.

Platform 118 is sized to snugly fit between the side walls 24 and 126 of base 114 with oppositely extending rod means 38 provided by carriage bolts (only one bolt 138 is shown in FIG. 6 having its head shown in dashed lines) positioned on the inside of tabs 172 and their threaded shafts extending outwardly through tabs 172 and through slots 132 and 134 provided in sidewalls 124 and 126. A lock washer 174A, flat washer 174B and a synthetic washer 174C, preferably made of TEFLON, are mounted on the threaded shaft of each bolt 138 between tabs 172 and side walls 124 and 126 of base 114. Hand knobs 176 and bolts 138 are threadingly received on each carriage bolt 138 (only one hand knob 176 is shown in FIGS. 5, 6 and 8 to 10). A synthetic washer 174D, preferably made of TEFLON, and a flat washer 174E are mounted on the threaded shaft of each bolt 38 between side walls 124 and 126 of base 114 and the hand knobs 176. Hand knobs 176 and bolts 138 cooperate with adjusting slots 132 and 34 as an adjusting means for varying and then locking the vertical height of the proximal end 166 of platform 118, as indicated by arrow 178 in FIG. 5. The adjustment for the vertical height of proximal end 166 will be described in detail presently.

Friction strips 180 are positioned at spaced locations along the width of platform 118, running from the promixal end 166 to the distal end 168 with a portion mounted on the under side of platform 118. Strips 180 are preferably made of an elastomeric material or they can be made of a cork material or the like. What is important is that strips 180 serves to grip the bottom side 156 of keyboard 116 to prevent keyboard 116 from sliding off platform 118, especially when the proximal end 166 (FIG. 6) of platform 118 is in a vertically elevated position, as shown in FIG. 10.

In use, the vertical height of cushion 144 above base plate 122 of base member 114 is varied by manipulation of hand knobs 150 to the left or in a counterclockwise direction as viewed in FIGS. 5 and 7. This causes the knobs 150 to unthread from their threaded relationship with bolts 136, which in turn causes that section of sidewalls 124 and 126 in the vicinity of slots 128 and 130 to release from their friction engagement with the opposed ends of support plate 142. The vertical height of the wrist support 112 is then adjusted, as shown by arrow 152 in FIG. 5, by moving wrist support 112 vertically up and down with bolts 136 moving along the length of adjusting slots 128 and 130. The tilt angle of wrist support 112 can also be adjusted at this time by rotating wrist support 112 about the axis of bolts 136 in adjusting slots 128 and 130, as indicated by arrow 154 in FIG. 5.

After wrist support 112 is adjusted to a comfortable vertical height and tilt angle, the position of wrist support 112 is locked in place by threading knobs 150 in a right or clockwise direction as viewed in FIGS. 5 and 8, to increase the threaded engagement between knob 150 and threaded bolts 138. This causes the knobs 150 to contact the upwardly extending sidewalls 124 and 126 of base 114 to draw them into a friction fit with the opposed vertical side walls 142A of support plate 142. The friction fit between knobs 150, sidewalls 24 and 26 and support plate 42 side walls 42A serves to lock both the tilt angle and vertical height of wrist support 112 at the desired position.

In a similar manner, the angle of inclination of the tiers of keys comprising the keyboard 116 is adjustable through a range of slopes by manipulation of the hand knobs 176. This is done by rotating hand knobs 176 to the left or in a counterclockwise direction, as viewed in FIGS. 5, 9 and 10, which causes knobs 176 to unthread from their threaded relationship with bolts 138, and thereby enable that section of sidewalls 124 and 126 in the vicinity of adjusting slots 132 and 134 to release from their friction engagement with the proximal end 166 of platform 118 and tabs 172. The vertical height of the proximal end 166 of platform 118 is then adjusted, as shown by arrow 178 in FIG. 5, by moving the proximal end 166 vertically up and down with bolt 138 moving along the length of adjusting slots 132 and 134.

As shown in FIG. 9, when bolt 138 is at its lower most extent in slots 132 and 134, the tier of keys slope toward the typist (not shown) at an incline of about +12 degrees. When the typist rests her hands on the cushion 144 of wrist support 112, she will need to reach approximately in a horizontal direction to strike the keys. This provides the typist with a "neutral" hand posture that helps alleviate hand stress caused by the typing motion. FIG. 10 shows the proximal end 166 (FIG. 6) of platform 118 positioned at the upper extent of slots 132 and 134 to provide the tiers of keys sloping away from the typist at a decline of about –4 degrees.

Once the desired slope of keyboard 116 supported on platform 118 is properly positioned, knobs 176 are turned to the right or in a clockwise direction to cause the knobs 176 to increase their threaded engagement with bolts 138 and thereby contact the upwardly extending side walls 124 and 126 of base 114. This in turn draws the side walls 124 and 126 into contact with the opposed tabs 172 and the proximal end 166 of platform 118 to hold platform 118 in a friction fit between the side walls 124 and 126.

Independent of the adjustment for the keypad and slope of platform 118, wrist support 112 is vertically adjustable through a variety of heights with threaded bolts 136 of wrist support 112 movable along the length of adjusting slots 128 and 130, as has previously been described in detail. Thus, with the wrist support 112 at any preferred position vertically above the proximal end of platform 118, the typist is required, with her hands resting on cushion 144, to reach approximately in a horizontal direction to strike the keyboard keys. This provides a "neutral" hand posture that helps relieve hand stress caused by the typing motion.

FIGS. 11 and 12 show another embodiment of a neutral positioning keyboard/wrist support device 210 of the present invention. Support device 210 comprises a wrist support member 212 adjustably supported on a base member 214 and a keyboard 216 positioned on a keyboard platform 218 that is adjustably attached to wrist support 212. This provides various vertical height adjustments for wrist support 212 above a support surface 220 for base member 214 independent of various adjustments of the slope of a platform 218 and its associated keyboard 216, as will be explained in detail presently.

Base member 214 is preferably fabricated as an integral member made from a sheet of suitable metal material that has been cut to size and folded to the proper shape, or base member 214 can be made of a plastic material that has been injection molded to shape or formed as an extrusion. Base 214 also can be made of wood or any other suitable material.

Base member 214 is longitudinally extending member comprised of a back wall 222 and a spaced apart front wall 224 that are both positioned in vertically extending planes, parallel with respect to each other. In use, the typist will be seated in a chair (not shown) in front of table 220 and adjacent to front wall 224. A horizontally extending upper wall 226 joins between the upper ends of the back and front walls 222 and 224 with a horizontal lower wall 228 extending outwardly from a lower end of back wall 222. Lower wall 228 lays on support surface 220 and helps provide stability for the support device 210 in a direction normal to the longitudinal extent of the base member 214.

Back wall 222 of base member 214 is provided with a back protrusion as a rib 230 that extends longitudinally along the length of an outer surface thereof, spaced above the lower wall 228 and support surface 220, In a similar manner, front wall 224 is provided with a longitudinally extending front protrusion as a rib 232 extending outwardly from an other surface thereof and spaced above support surface 220 at a height similar to that of rib 230. As shown in FIGS. 11 and 12, base member 214 is made of a foldable material, such as sheet metal, with walls 222 and 224 folded down upon themselves to provide the respective back and front ribs 230 and 232 preferably aligned along a plane parallel with horizontal table surface 220 and at a vertical height spaced nearer upper wall 226 at about a quarter of the height of the back and front walls 222 and 224. Ribs 230 and 232 provide a first adjusting means for varying the height position of support member 212 with respect to base member 214 and above support surface 220, as will presently be described. Base member 214 also can be made of a plastic material that has been injection-molded. In this case, ribs 230 and 232 would not be provided with the crease shown in FIGS. 11 and 12, which result from folding the sheet metal.

Support member 212 is also preferably formed as an integral member made from a sheet of a suitable sheet metal material that has been cut to size and folded to the proper shape. Support member 212 can also be made of an extruded or injection molded plastic material and comprises a back wall 234 and a spaced apart front wall 236 that are both positioned in vertically extending planes parallel with respect to each other.

An upper wall 238, which serves as a hand rest means, joins with back wall 234 at an upper edge thereof and extends in a horizontal plane towards front wall 236 where in the vicinity of the front wall 236, upper wall 238 meets a generally cylindrical sectional portion 240 that joins with upper wall 238 and front wall 236. A cushion means 240 is mounted on upper wall 238 and has a generally rectangular cross-section with a curved side 242 adjacent cylindrical sectional portion 140. Cushion means extends the length of upper wall 238 and is preferably made of foam rubber 244 or other suitably spongy material with a durable cover 246 enveloping the foam member 244. In the alternative, upper wall 238 can be provided with a sheet of cushion material.

As shown in FIGS. 11 and 12, back wall 234 of wrist support member 212 is provided with a plurality of longitudinally extending back channels 248, 250 and 252 provided along the inner surface thereof. Channels 248 to 252 are equally spaced at vertical intervals along wall 234 and have a U-shape that is sized to receive the back rib 230 provided on the back wall 222 of base member 214. In a similar manner, front wall 236 of wrist support member 214 is provided with a plurality of equally spaced and longitudinally extending front channels 254, 256 and 258 provided along the inner surface thereof. Channels 254 and 258 have a U-shape similar to back channels 248 to 252 and are sized to receive the front rib 232 provided on wall 224 of base member 214.

Preferably corresponding channel sets 248 and 254, 250 and 256, and 252 and 258 are provided along a plane parallel with horizontal surface 220 and provide a second adjusting means that cooperates with the first adjusting means provided by the ribs 230 and 232 of base member 214 to vary the vertical height of support member 212. In that manner, the mating relationship between back and front channels 248 to 252 and 254 to 258, and respective back and front ribs 230 and 232 provide for varying the vertical height of wrist support member 212 with respect to base member 214 to adjust the height of cushion means 240 above support surface 220, as will be explained in detail presently. In FIGS. 11 and 12, back ribs 230 is shown mated with back channel 250 and front rib 232 is mated with front channel 256.

As particularly shown in FIG. 12, each of the U-shaped front channels 248 to 252 provided on the back wall 234 of wrist support member 212 has a longitudinally extending cut 260 at a lower portion of the channels 248 to 252. The resulting severed material is bent in an upwardly direction to form respective second channels 262, 264 and 266 having a generally J-shaped cross-section. Second channels 262 to 266 do not extend the entire longitudinal length of the respective first channels 248, 250 and 252 but instead begin and end at positions spaced from the opposed ends of wall 234 of wrist support member 212. This provides the ends of back wall 234 (only one end shown in FIG. 11 as a continuum). Second channels 262 to 266 provide a third adjusting means that receives a mating fourth adjusting means of platform 218 to provide for varying the vertical height of a proximal end 268 (FIG. 12) of platform 218 above support surface 220 and therefore the magnitude of the slope of keyboard 216 supported on platform 218, as will be described presently.

As shown in FIGS. 11 and 12, platform 218 is preferably approximately as wide as keyboard 216 which is a conventional type of the kind that is customarily associated with a computer terminal or computer workstation (not shown) and the like. Keyboard 216 comprises a planar bottom side 270 positioned on a generally flat plate portion 272 of platform 218, and an upper side 274 with connecting back and front ends 276 and 278. In side elevational view (FIG. 12), the width between the lower side 270 and the upper side 274 widens as the keyboard 216 extends from its front end 278 to the back end 276. A plurality of keys 280 are arranged in rows extending above the upper side 274 of keyboard 216 to provide tiers 282A, 282B, 282C, 282D, 282E and 282F of keys 280 that slope from front end 278 towards the back end 276 of keyboard 216.

Platform 218 is a longitudinally extending member comprised of the generally flat plate portion 272 provided between the proximal end 268 forming a longitudinally extending and downwardly turned flange 284 and a distal end 286 that extends downwardly and somewhat outwardly from plate 272, with distal end 286 positioned on support surface 220. Downturned flange 284 provides the male component that mates with wrist support member 212 to provide for adjusting the magnitude of the slope of keyboard 216, as will presently be described. Flange 184 and distal end 286 are of sufficient length to prevent platform 278 from "rocking" on support surface 220 in a lateral direction along the axis of the support member 212 and base member 214.

A friction pad 288 is positioned on the plate portion 272 of platform 218 and is made of an elastomeric material or pad 288 can be made of a cork material or the like. Friction strips similar to strips 80 shown mounted on platform 18 in FIGS. 5 and 6 are also contemplated by the scope of the present invention. What is important is that pad 288 serves to grip the bottom side 270 of keyboard 216 to prevent keyboard 216 from sliding off platform 218. In use, the vertical height of cushion 240 is adjusted by first moving wrist support member 212 in a longitudinal direction with respect to the base member 214, either into or away from the plane of the paper a shown in FIG. 11, with the back and front channels 250 and 256 moving over the respective back and front ribs 230 and 232 until the ends of support member 212 is clear of base member 214. Support member 212 is now free to be moved vertically in an upwardly or downwardly direction to position cushion means 240 at a comfortable vertical height for the typist working at the keyboard 216. In FIGS. 11 and 12; there are shown three height adjustments from which to choose corresponding to each set of matching channels 248 and 254, 250 and 256, and 252 and 258 provided on wrist support member 212. It should be understood that although three sets of channels are shown, wrist support member 212 can be provided with a greater or lesser number of sets of channels as desired. The vertical height of cushion 240 about support surface 220 is thereby preferably adjustable through a range of heights from about 2⅝ inches to 3⅞ inches.

When the height of wrist support member 212 is properly adjusted, the matching set of channels 248 and 254, 250 and 256 or 252 and 258 that is selected is aligned with the back and front ribs 230 and 234 and wrist support member 112 is moved along base member 114 in a longitudinal direction; until the ends of support member 212 are vertically coplanar with the ends of base member 114. The cushion means 240 is now positioned at a vertical height that is comfortable for the typist when she rests the heels of her hands thereupon, as she works at the keyboard 216.

After the vertical height of cushion 240 has been adjusted, the magnitude of the slope of platform 218 and associated keyboard 116 is adjusted. This is performed by positioning flange 284 located at the proximal end 268 of the platform 218 in the appropriate J-shaped second channel 262, 264 or 266 to provide the tiers 282A to 282F of keys 280 on keyboard 216 with a slope that is comfortable to the typist in conjunction with the vertical height of wrist support 212. In FIGS. 11 and 12, there are shown three adjustment positions for the magnitude of the slope of keyboard 216 corresponding to the J-shaped channels 262 and 266. It should be understood that a greater or lesser number of J-shaped channels can be provided without deviating from the scope of the present invention.

As shown in FIGS. 11 and 12, the slope of platform 218 is adjustable within a preferred range of about a −4 degree decline with respect to support surface 220 with ribs 230 and 232 on base member 214 positioned in channels 248 and 254 provided on wrist support member 212 and flange 284 received in the lowermost second channel 266, to about a −20 degree decline with respect to support surface 220 with ribs 230 and 232 positioned in channels 252 and 158 and flange 184 received in uppermost second channel 262. However, by adjusting the various combinations of ribs 230 and 232 mated to sets of matching channels 248 and 254, 250 and 256, and 252 and 258, and the flange 284 of platform 218 positioned in J-shaped channels 262 and 266, the magnitude of the sloping incline can be varied to seven (7) different magnitudes within the operating range for the neutral-positioning keyboard/wrist support device 210 shown in FIGS. 11 and 12. Providing device 210 with a greater or lesser number of mating ribs and sets of U-shaped channels and a greater or lesser number of J-shaped channels will vary the number of magnitudes of the sloping incline for platform 218.

Obviously, numerous variations and modifications can be made without departing from the spirit of the present invention. Therefore, it should be clearly understood that the form of the present invention described above and shown in the figures of the accompanying drawings are illustrative only and not intended to limit the scope of the present invention.

What is claimed is:

1. A computer keyboard support device, which comprises:

a) base means positioned on a support surface;

b) support means comprising a hand rest means adapted to support the heels of a user's hands, wherein the support means and base means are provided with cooperating height adjusting means that provide for selectively varying the vertical height of the hand rest means above the support surface and wherein the support means and the base means are provided with cooperating tilt adjusting means that provide for selectively varying the tilt angle of the hand rest means; and c) platform means adapted to support a keyboard thereon with a proximal end of the platform means proximate the user and either the base means or the support means provided with cooperating platform adjusting means for selectively varying the vertical height of the proximal end of the platform means with a distal end of the platform means supported on the support surface, the distal end spaced below the proximal end, wherein when the keyboard is positioned on the upper surface of the platform means, the keyboard has its plurality of keys arranged in tiers with a sloping angle of inclination that is adjustable between a positive inclination with the tiers of keys sloping towards the user and a reversely sloping decline having the tiers of keys sloping downwardly and away from the user and, wherein adjustment of the vertical height of the hand rest means, the tilt angle of the hand rest means and the slope of the platform means supporting the keyboard thereon are independent of each other.

2. A wrist and computer keyboard support device, which comprises:

a) base means having a lower end positioned on a support surface and an upper end, wherein the base means is provided with a first adjusting means;

b) support means mounted on the base means and comprising a hand rest means adapted to support the heels or wrists of a user's hands, wherein the support means has a second adjusting means that cooperates with the first adjusting means of the base means for selectively varying the vertical height of the hand rest means above the support surface and for selectively varying the tilt angle of the hand rest means, and wherein the support means is positioned intermediate the user and the keyboard and either the base means or the support means is provided with a third adjusting means; and c) platform means adapted to support a keyboard thereon with a proximal end of the platform means nearest to the user having a fourth adjusting means that cooperates with the third adjusting means to provide for selectively varying the vertical height of the proximal end of the platform means with a distal end of the platform means supported on the support surface, the distal end spaced below the proximal end, wherein when the keyboard is positioned on the upper surface of the platform means, the keyboard has its plurality of keys arranged in tiers having a sloping angle of inclination, and wherein adjustment of the vertical height of the hand rest means, the tilt angle of the hand rest means and the slope of the platform means for supporting the keyboard thereon are independent of each other.

3. The keyboard support device of claim 2 wherein the hand rest means is spaced vertically above the proximal end of the platform means and the keyboard supported thereon.

4. The keyboard support device of claim 2 wherein the base means is comprised of opposed vertically extending and parallel base walls having lower ends positioned on the support surface, the opposed base walls connected together by a joining means and provided with the first adjusting means and wherein the support means includes opposed, vertically extending support walls positioned proximate the base walls and having the second adjusting means, wherein the first and second adjusting means provide for vertical adjustment of the support means relative to the base means to vary the vertical height of the hand rest means above the support surface and to provide for adjusting the tilt angle of the hand rest means.

5. The keyboard support device of claim 4 wherein the first adjusting means comprises opposed first slot means extending vertically through the base walls and wherein the second adjusting means comprises first rod means attached to the support means with opposed ends extending through the first slot means and being movable and rotatable therein to adjust the vertical height and tilt angle of the hand rest means and wherein a first locking means is provided on at least one of the opposed ends of the first rod means to engage the base walls of the base means to lock the first rod means and associated support means at a desired position along the first slot means to thereby provide for locking the adjustment of the vertical height and the adjustment of the tilt angle of the hand rest means above the support surface.

6. The keyboard support device of claim 5 wherein the first rod means comprises first threaded shaft means and the first locking means comprises first hand wheel means that threadingly mate with the opposed threaded ends of the first shaft means and wherein the first hand wheel means are rotatable in a first direction to unthread from the first shaft means and release from contact with the opposed base walls of the base means to provide for adjusting the vertical height of the support means by moving the first shaft means along the first slot means and to provide for adjusting the tilt angle of the hand rest means by rotating the support means about the first shaft means and wherein the first hand wheel means is rotatable in a second, opposite direction to contact the base walls of the base means to thereby lock the vertical height and the tilt angle of the hand rest means with the base walls of the base means held in a friction fit between the support walls of the support means and the first hand wheel means.

7. The keyboard support device of claim 2 wherein the base means is comprised of opposed vertically extending and parallel base walls having lower ends positioned on the support surface, the opposed base walls each connected together by a joining means and provided with the third adjusting means comprising opposed second slot means extending vertically through the base walls, and wherein the fourth adjusting means comprises second rod means attached to the proximal end of the platform means and having opposed ends extending through the second slot means with a second locking means provided on at least one of the opposed ends of the second rod means, wherein the second locking means cooperate with the base walls of the base means to provide for vertical adjustment of the proximal end of the platform means along the second slot means to vary the slope incline of the platform means and to lock the second rod means and associated platform means at a desired position along the second slot means to thereby lock the adjusted slope of the platform means.

8. The keyboard support device of claim 7 wherein the second rod means comprises a second threaded shaft means and the second locking means comprises second hand wheel means that threadingly mate with the opposed threaded ends of the second shaft means and wherein the second hand wheel means are rotatable in a first direction to unthread from the second shaft means and release from contact with the opposed base walls of the base means to provide for adjusting the slope of the platform means by moving the second shaft means along the second slot means and wherein the second hand wheel means are rotatable in a second, opposition direction to contact the base walls of the base means to thereby lock the slope of the platform means with the base walls of the base means held in a friction fit between the platform means and the second hand wheel means.

9. The keyboard support device of claim 3 wherein the base means is comprised of opposed vertically extending and parallel base walls having lower ends positioned on the support surface, the opposed base walls each provided with the first adjusting means and connected together by a joining means, and wherein the support means is comprised of opposed, vertically extending support walls that provide for supporting the hand rest means, the support walls positioned proximate the base walls and having the second adjusting means, wherein the first adjusting means provided on the base walls of the base means comprise opposed first slot means extending vertically through the base walls and wherein the second adjusting means comprise first rod means attached to the support means with opposed ends of the first rod means extending through the first slot means of the base means and being movable and rotatable therealong to adjust the vertical height and tilt angle of the hand rest means and wherein a first locking means is provided on at least one of the opposed ends of the first rod means to cooperate with the base walls to lock the first rod means and associated support means at a desired position along the first slot means to thereby provide for locking the adjustment of the vertical height and the adjustment of the tilt angle of the hand rest means above the support surface and wherein the base means are provided with the third adjusting means comprising opposed second slot means extending vertically through the base walls and wherein the fourth adjusting means comprises second rod means attached to the proximal end of the platform means with opposed ends of the second rod means extending through the second slot means of the base means and movable therealong with a second locking means provided on at least one of the opposed end of the second rod means, the second locking means cooperating with the base walls comprising the base means to lock the second rod means and associated platform means at a desired position along the second slot means to thereby lock the adjusted slope of the platform means.

10. A wrist and computer keyboard support device, which comprises:

a) base means having a lower end positioned on a support surface and an upper end, wherein the base means is provided with a first adjusting means;

b) support means supported on the base means and comprising a hand rest means adapted to support the heels of a user's hands, wherein the support means has a second adjusting means adapted to cooperate with the first adjusting means to provide for selectively adjusting the vertical height of the hand rest means above the support surface, and wherein the support means is positioned intermediate the user and the keyboard and either the base means or the support means is provided with a third adjusting means; and c) platform means adapted to support a keyboard thereon with a proximal end of the platform means nearest to the user having a fourth adjusting means that cooperates with the third adjustment means to selectively vary the vertical height of the proximal end of the platform means above the support surface with a distal end of the platform means supported on the support surface, the distal end spaced below the proximal end, wherein when the keyboard is positioned on the upper surface of the platform means, the keyboard has its plurality of keys arranged in tiers having a sloped angle of inclination, and wherein adjusting the vertical height of the hand rest means is independent of the adjustment of the slope of the platform means supporting the keyboard.

11. The keyboard support device of claim 10 wherein the base means is comprised of opposed vertically extending and parallel base walls having lower ends positioned on the support surface, the opposed base walls each provided with the first adjusting means and connected together by a joining means and wherein the support means is comprised of opposed, vertically extending support walls that provide for supporting the hand rest means, the support walls positioned proximate the base walls and having the second adjusting means, wherein the first and second adjusting means provide for vertical adjustment of the height of the hand rest means above the support surface.

12. The keyboard support device of claim 11 wherein the first adjusting means provided on the base walls of the base means comprises opposed longitudinal protrusions provided on an outer surface of the base walls and wherein the second adjusting means comprises a plurality of first channel means formed on an inside surface of the support walls of the support means, the protrusions being operatively associated with the plurality of first channel means so that the support means is longitudinally movable with respect to the base means to separate the support means from the base means to provide for adjusting the cooperating relationship between the first and second adjusting means to vary the vertical height of the hand rest means above the support surface.

13. The keyboard support device of claim 10 wherein the hand rest means is spaced vertically above the proximal end of the platform means and the keyboard supported thereon.

14. The keyboard support device of claim 10 wherein the support means is comprised of opposed, vertically extending support walls that provide for supporting the hand rest means joined therebetween, the one support wall spaced furthest from the user being provided with the third adjusting means which cooperates with the fourth adjusting means to provide for adjusting the slope of the platform means.

15. The keyboard support device of claim 14 wherein the third adjusting means comprises a plurality of spaced, longitudinal second channel means formed on an outer surface of the one support wall of the support means and the fourth adjusting means comprises a flange means provided at the proximal end of the platform means and selectively received in the second channel means to adjust the slope of the platform means relative to the support means.

16. The keyboard support device of claim 10 wherein the hand rest means of the support means is provided with a cushion means.

17. The keyboard support device of claim 10 wherein the upper surface of the platform means is provided with a friction means that grips a bottom surface of the keyboard to prevent the keyboard from moving with respect to the upper surface thereof.

18. A computer keyboard support device for supporting the heels of a user's hands while the user works at a keyboard having a plurality of keys arranged in tiers, which comprises:

a) base means comprising opposed base walls extending in parallel vertical planes and having lower ends positioned on a generally planar support surface, wherein the base walls are connected by a joining means;

b) support means positioned intermediate the user and the keyboard and comprising a pair of parallel and vertically disposed support walls having outer surfaces and inner surfaces with a hand rest means joining between the support walls, the inner surfaces of the support walls positioned adjacent to an outer surface of the base walls with the hand rest means in a spaced relationship, vertically above the joining means and wherein the support means is longitudinally movable with respect to the base means to separate the support means from the base means;

c) means for adjusting a vertical height of the hand rest means relative to the joining means after relative longitudinal movement of the support means with respect to the base means, thereby defining a plurality of vertical heights for the hand rest means above the support surface;

d) platform means having an upper surface adapted to support the keyboard thereon, the upper surface provided between a proximal end and a distal end of the platform means with the distal end positioned on the support surface, wherein the proximal end of the platform means nearest to the user is positioned adjacent to the outer surface of the one support wall of the support means spaced furthest from the user and adjacent to the keyboard; and e) means for adjusting a slope of the platform means relative to the one support wall to provide a plurality of sloping positions for the platform means after relative vertical movement of the proximal end thereof with respect to the one support wall thereby defining a plurality of magnitudes for the slope of the keyboard, the adjustment of the vertical height for the hand rest means functioning independently of the adjustment of the slope of the platform.

19. The keyboard support device of claim 18 wherein the hand rest means is spaced vertically above the proximal end of the platform means and the keyboard supported thereon.

20. The keyboard support device of claim 18 wherein the means for adjusting the vertical height of the hand rest means comprises a plurality of spaced, longitudinal first channel means formed on at least one of the inner surfaces of the support walls of the support means and a longitudinal protrusion provided on at least one of the outer surfaces of the base walls of the base means, the protrusion being operatively slidable in a longitudinal direction along the channel means to mate the support means with the base means and to prevent the base means and support means from further relative vertical movement.

21. The keyboard support device of claim 18 wherein the means for adjusting the slope of the platform means comprises a plurality of spaced, longitudinal receiver means formed on the outer surface of the one support wall of the support means and a receivable means provided at the proximal end of the platform means and operatively received in the receiver means to adjust the slope of the platform means relative to the support means and thereby the magnitude of the slope of the keyboard.

22. The keyboard support device of claim 21 wherein the receiver means is provided by a plurality of second channel means formed on the outer surface of the one support wall of the support means and the receivable means is provided by a flange means extending downwardly from the proximal end of the platform means and selectively receivable in the second channel means to adjust the slope of the platform means relative to the support means.

* * * * *

UNITED STATES PATENT AND TRADEMARK OFFICE

CERTIFICATE OF CORRECTION

PATENT NO. : 5,513,824

DATED : May 7, 1995

INVENTOR(S) : Leavitt et al.

It is certified that error appears in the above-identified patent and that said Letters Patent are hereby corrected as shown below:

Title page, item [54] - the title should be --NEUTRAL-POSITIONING KEYBOARD/WRIST SUPPORT--.

Signed and Sealed this

Sixteenth Day of July, 1996

*Attest:*

*Attesting Officer*

BRUCE LEHMAN

*Commissioner of Patents and Trademarks*